United States Patent [19]

Petito et al.

[11] 4,437,844

[45] Mar. 20, 1984

[54] METHOD OF MAKING ORGANIC-RETINA (PYROELECTRIC) VIDICON

[75] Inventors: Ferdinand C. Petito, Alexandria; Gerald Klauber, Fredericksburg, both of Va.

[73] Assignee: The United States of America as represented by the Secretary of the Army, Washington, D.C.

[21] Appl. No.: 335,921

[22] Filed: Dec. 30, 1981

[51] Int. Cl.[3] ..... H01J 31/49

[52] U.S. Cl. ..... 445/5; 427/74; 445/35

[58] Field of Search ..... 445/5, 6, 9, 16, 19, 445/40, 41, 42, 22, 23, 44

[56] References Cited

U.S. PATENT DOCUMENTS

| | | | |
|---|---|---|---|
| 3,658,401 | 4/1972 | Files | 445/42 |
| 3,999,698 | 12/1976 | Conklin | 445/29 |
| 4,030,789 | 6/1977 | Schampers | 445/44 |
| 4,104,771 | 8/1978 | Clark | 427/74 |
| 4,395,243 | 7/1983 | Toyama et al. | 445/6 |

FOREIGN PATENT DOCUMENTS

| | | | |
|---|---|---|---|
| 1172200 | 2/1959 | France | 445/23 |

*Primary Examiner*—Kenneth J. Ramsey
*Assistant Examiner*—Kurt Rowan
*Attorney, Agent, or Firm*—Robert P. Gibson; Milton W. Lee; Aubrey J. Dunn

[57] ABSTRACT

A temporary faceplate is bonded to an assembled (except for retina) vidicon tube. The tube is baked under vacuum pumping at high temperature to cause evaporation or outgassing of contaminants. After cooling, the tube is placed in an inert atmosphere and the temporary faceplate is exchanged for a pyroelectric faceplate. Vacuum is again pumped and the end of the tube containing the electron gun electrodes and the other electrodes is baked for degassing the electrodes. Still under vacuum pumping, the getters and the cathode of the electron gun are heated to activate them, the retina is activated with anode current by applying voltages to the electron gun and the acceleration electrodes by applying focus and sweep fields to the tube, the getters are fired, and the anode current is used to electron beam scrub the retina and other electrodes. Finally, the tube is tipped-off.

3 Claims, 1 Drawing Figure

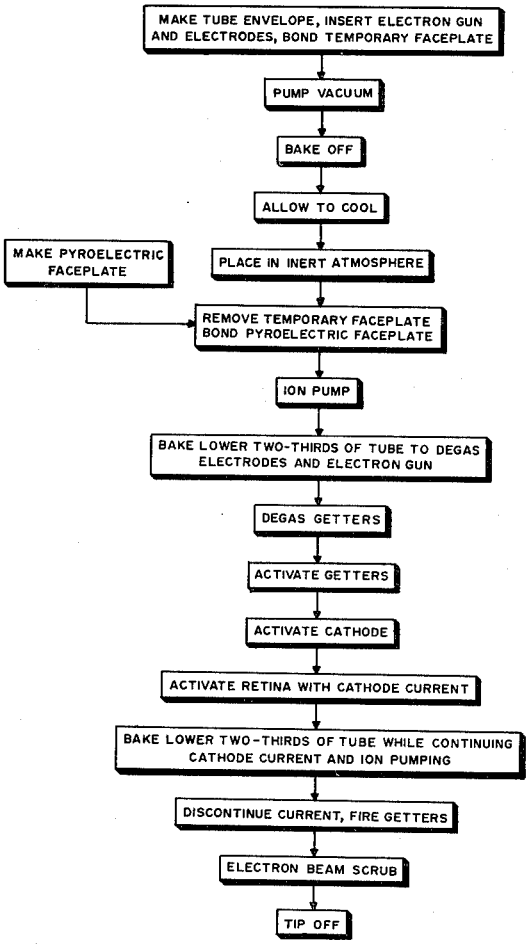

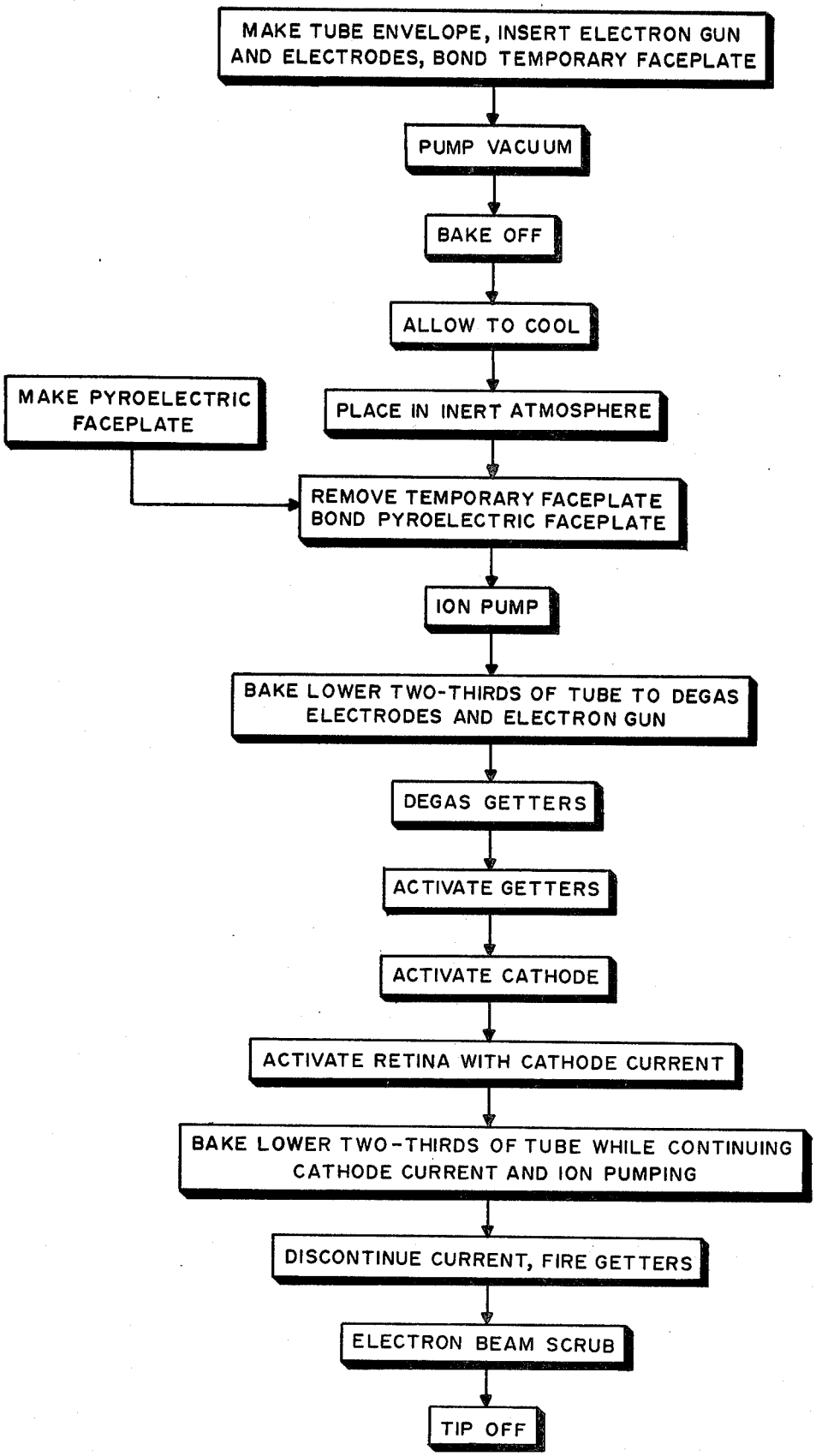
MAKE TUBE ENVELOPE, INSERT ELECTRON GUN AND ELECTRODES, BOND TEMPORARY FACEPLATE
PUMP VACUUM
BAKE OFF
ALLOW TO COOL
MAKE PYROELECTRIC FACEPLATE
PLACE IN INERT ATMOSPHERE
REMOVE TEMPORARY FACEPLATE BOND PYROELECTRIC FACEPLATE
ION PUMP
BAKE LOWER TWO-THIRDS OF TUBE TO DEGAS ELECTRODES AND ELECTRON GUN
DEGAS GETTERS
ACTIVATE GETTERS
ACTIVATE CATHODE
ACTIVATE RETINA WITH CATHODE CURRENT
BAKE LOWER TWO-THIRDS OF TUBE WHILE CONTINUING CATHODE CURRENT AND ION PUMPING
DISCONTINUE CURRENT, FIRE GETTERS
ELECTRON BEAM SCRUB
TIP OFF

METHOD OF MAKING ORGANIC-RETINA (PYROELECTRIC) VIDICON

The invention described herein may be manufactured, used, and licensed by the U.S. Government for governmental purposes without the payment of any royalties thereon.

BACKGROUND OF THE INVENTION

This invention is in the field of electronic vidicon camera tubes, and, in particular, those tubes usable at infrared wavelengths. The only generally known types of infrared vidicons at present are those with pyroelectric retinas (also called targets or signal plates). Regardless of the type of retina used, the greatest problem in the manufacture of camera tubes (and other types of vacuum tubes as well) is that of removing or reducing contamination, particularly those contaminants which might remain in the tube after all its elements are in place and final vacuum pumping is finished. The contaminants can be in the form of submicroscopic particles, gases, or vapors, and are partially removed by baking the tubes under vacuum, after all elements, i.e., grids, electron gun, retina, etc. are in place. One of the final steps in tube manufacture is the firing of a "getter" inside the tube. This getter includes an alkali metal which is evaporated and whose ions combine with ions of contamination in the tube; the evaporated metal (and the ions with which it combined) condenses on the tube walls or is pumped out of the tube. All of the baking, pumping, and firing of a getter are well known in tube manufacture, but cannot be directly used with a pyroelectric retina. This is because the normal baking temperatures may exceed 450° C. and the fact that the TGS (triglycine sulfate) family of retina materials have relatively low melting points (233° C. for TGS) and visibly char in short times at the melting points (less than a minute for TGS). The present invention teaches a method of making a pyroelectric vidicon that avoids the problem of retina charing.

SUMMARY OF THE INVENTION

The invention is a method of making a pyroelectric vidicon tube. In order to allow high temperature baking of the tube, the retina is not inserted until preliminary baking is finished. To accomplish this, a temporary faceplate is mounted on the vidicon and the conventional electron gun and other electrodes are inserted. A vacuum is applied (continuously pumped) and the tube is baked out in the usual manner. The temporary faceplate is then removed in a inert atmosphere and the pyroelectric faceplate is mounted. Vacuum is again drawn and the lower two-thirds of the tube is baked to degas any gas absorbed from the inert atmosphere by the electron gun or electrodes. Still under vacuum, the getter is degassed, the cathode is activated by anode current, the lower two-thirds of the tube is again baked while continuing anode current, the getters are fixed (with no anode current), the inside of the tube is electron-beam scrubbed, and finally, the tube is tipped-off.

BRIEF DESCRIPTION OF THE DRAWINGS

The single drawing FIGURE is a flow chart of the inventive method.

DESCRIPTION OF THE PREFERRED EMBODIMENT

The invention might be best understood when this description is taken in conjunction with the drawing. As can be seen at the top of the drawing, the first major step of the method includes the steps of making the tube envelope, inserting the electron gun and other electrodes, and bonding a temporary faceplate onto the tube envelope. The assembly thus made is connected to a vacuum manifold and vacuum is pumped to $8\times10^{-9}$ torr. While pumping is continued, the tube is baked at 300° C. until a pressure of $5\times10^{-8}$ torr can be maintained. When this pressure stabilizes, the tube is allowed to cool to room temperature and drop in pressure to $8\times10^{-9}$ is realized. The steps thus far described remove contamination from the electron gun, the other electrodes, and the internal tube walls.

If desired, the tube may now be pinched off and stored in an inert environment for a short time without ill effects.

The process continues in an inert atmosphere. The tube temporary faceplate is removed, and the pyroelectric faceplate, which has already been made by coating a glass plate with TGS or other pyroelectric retina material, is bonded (fused) to the tube envelope. Vacuum is again applied and pumping continues until tube pressure stabilizes at $2\times10^{-9}$ torr. The lower two-thirds of the tube is now baked such that retina temperature does not exceed 70° C. and the pressure does not exceed $8\times10^{-9}$ torr. When the bakeout pressure stabilizes at 2 to $3\times10^{-9}$ torr, the bakeout is discontinued. The next step of the process is the degassing of the tube getters. This is done by heating the getters so as not to exceed tube pressure of $8\times10^{-9}$ torr. When degassing is complete, the pressure should return to 2 to $4\times10^{-9}$ torr. Activation of the cathode is now done in the usual manner by energizing the cathode heater. System pressure is kept at or below $8\times10^{-9}$ torr during cathode activation and during retina activation. The retina is activated by heating with anode current, care being taken not to exceed 70° C. retina temperature. The electrons of the anode current are focused into a beam and this beam is swept in a raster pattern on the retina by applying the proper voltages to the tube electrodes and to external sweep circuits. These activation steps induce outgassing of organic binders used to make the cathode and retina. After activation, anode current is continued and a bakeout temperature of 75° C. is used on the lower two-thirds of the tube. The bakeout is continued until tube pressure holds at $2\times10^{-9}$ torr for at least twenty-four hours. When the twenty-four hours have passed, bakeout is discontinued, the various voltages are disconnected, and the getters are fired, i.e., heated sufficiently to evaporate their alkali metal coatings. The firing is done so that the ion pump is not overloaded. The system is given forty-eight hours after getter firing to recover and pressure stabilize at $2\times10^{-9}$ torr. The next step is electron beam scrubbing of the retina and tube electrodes to remove any surface contaminants. This scrubbing is accomplished by again applying the proper voltages to the tube and to deflection coils about the tube in order to again draw anode current. A scrub of twenty-four hours is usually sufficient for surface cleaning. The tube is considered "hard" when changes in anode voltage produce no change in pressure. The final step (after the voltages are removed) is tips-off of the tube.

Although it has not been specifically mentioned above, it should be understood that one of the other electrodes of the tube is the output electrode for the retina or faceplate. This electrode usually takes the form of a metal ring at the faceplate end of the tube and is made to contact the faceplate and to have a portion exposed outside the tube envelope.

We claim:

1. A method of making an organic-retina vidicon which includes the following steps:

(a) make a glass tube envelope, insert the electron gun, the getters, and other electrodes in the lower two-thirds of the envelope, bond to the envelope a temporary faceplate to produce a tube assembly;

(b) vacuum pump the assembly;

(c) bake the assembly;

(d) allow the assembly to cool;

(e) place the assembly in an inert atmosphere;

(f) make an organic-retina faceplate and place in the inert atmosphere containing the assembly;

(g) remove the temporary faceplate and bond the organic-retina on the tube envelope to produce a new assembly;

(h) vacuum pump the new assembly;

(i) bake the lower two-thirds of the new assembly;

(j) heat the getters to degas same;

(k) activate the electron gun cathode by heating same;

(l) activate the retina by heating with anode current;

(m) bake the lower two-thirds of the new assembly while continuing anode current;

(n) discontinue anode current, fire getters;

(o) electron beam scrub the retina and other tube electrodes;

(p) tip-off the envelope.

2. The method as recited in claim 1 wherein vacuum pumping is continued during all steps (c), (d), and (i) through (o) inclusive.

3. The method as recited in claim 1 wherein step (l) is accomplished by applying voltages to the electron gun and other electrodes of the new assembly and by applying focus and sweep magnetic fields to said new assembly.

* * * * *